US005874919A

United States Patent [19]

Rawnick et al.

[11] Patent Number: 5,874,919

[45] Date of Patent: Feb. 23, 1999

[54] STUB-TUNED, PROXIMITY-FED, STACKED PATCH ANTENNA

[75] Inventors: James J. Rawnick, Palm Bay; Brian D. Anderson, Melbourne; Gregory M. Turner; Jeffrey A. Bensen, both of Palm Bay, all of Fla.

[73] Assignee: Harris Corporation, Melbourne, Fla.

[21] Appl. No.: 781,542

[22] Filed: Jan. 9, 1997

[51] Int. Cl.[6] ..... H01Q 1/38

[52] U.S. Cl. ..... 343/700 MS; 343/846

[58] Field of Search ..... 343/700 MS, 745, 343/749, 815, 818, 846, 848, 829, 831

[56] References Cited

U.S. PATENT DOCUMENTS

| | | | |
|---|---|---|---|
| 4,386,357 | 5/1983 | Patton | 343/700 MS |
| 4,835,538 | 5/1989 | McKenna et al. | 343/700 MS |
| 4,853,703 | 8/1989 | Murakami et al. | 343/700 MS |
| 5,155,493 | 10/1992 | Thursby et al. | 343/700 MS |
| 5,243,353 | 9/1993 | Nakahara et al. | 343/700 MS |
| 5,309,163 | 5/1994 | Ngan et al. | 343/700 MS |
| 5,386,214 | 1/1995 | Sugwara | 343/700 MS |
| 5,396,202 | 3/1995 | Scheck | 343/700 MS |
| 5,633,645 | 5/1997 | Day | 343/700 MS |

OTHER PUBLICATIONS

"Increasing the Bandwidth of Microstrip Antenna by Proximity Coupling", *Electronics Letters*, vol. 23, No. 8, Apr. 9, 1987.

"A Survey of Broadband Microstrip Patch Antennas", *Microwave Journal*, Sep., 1996, pp. 60–84.

"Experimental Investigaton of Three–Layer Electromagnetically Coupled Circular Microstrip Antennas", *Electronic Letters*, vol. 27, No. 13, Jun. 20, 1991, pp. 1187–1189.

"An Impedance–Matching Technique for Increasing the Bandwidth of Microstrip Antennas", by Hugo F. Pues and Antoine R. Van De Capelle, *IEEE Transactions on Antennas and Propagation*, vol. 37, No. 11, Nov. 1989, pp. 1345–1354.

"Broadband Microstrip Antenna Design with the Simplified Real Frequency Technique" by Hongming An, Bart K.J.C. Nauwelaers and Antoine R. Van de Capelle, *IEEE Transactions on Antennas and Propagation*, vol. 42, No. 2, Feb., 1994, pp. 129–136.

"A Class of Enhanced Electromagnetically Coupled Feed Geometries for Printed Antenna Applications" by Das et al; 1990 IEEE; pp. 1100–1103.

"Stacked Microstrip Antenna with Wide Band and High Gain" by Egashira et al; 1990 IEEE, pp. 1132–1135.

"Displaced Multilayer Triangular Elements Widen Antenna Bandwidth", vol. 24, No. 15, Jul. 21, 1988, *Electronics Letters*, pp. 962–964.

(List continued on next page.)

*Primary Examiner*—Don Wong
*Assistant Examiner*—Tan Ho
*Attorney, Agent, or Firm*—Charles E. Wands

[57] ABSTRACT

A reduced weight, low profile, stacked patch antenna includes an 'active' antenna patch element, a 'parasitic' antenna patch element, and a tuning stub portion of a microstrip feed, which resonate at respectively different frequencies. The tuning stub is located adjacent to the active patch element, so that electromagnetic field energy associated with the tuning stub is coupled to the active and parasitic patches of the stacked patch structure, thereby creating a distributed resonance characteristic, having an augmented bandwidth compared with that of a conventional patch antenna. Manufacture of the stacked patch antenna is facilitated by the use of both a proximity feed and the interleaving of layers of adhesive material among the respective components of the stacked structure.

23 Claims, 2 Drawing Sheets

OTHER PUBLICATIONS

"Effect of Substrate Thickness on the Performance of a Circular–Disk Microstrip Antenna" by Dahele et al; vol. Ap–31, No. 2, Mar. 1983, *IEEE Transactions on Antennas and Propagation*; pp. 358–360.

"The SSFIP Principle", Chapter 3, *Broadband Patch Antenna*, pp. 45–61.

"The Effect of Various Parameters of Circular Microstrip Antennas on Their Radiation Efficiency and the Mode Excitation", by A.A. Kishk et al; vol. AP–34. No. 8. Aug., 1986, *IEEE Transactions on Antennas and Propagation*, pp. 969–976.

"Experimental Study of the Two–Layer Electromagnetically Coupled Rectangular patch Antenna", vol. 38, No. 8, Aug. 1990, *IEEE Transactions on Antennas and Propagation*, 1298–1302.

"Broadband Gap –Coupled Microstrip Antenna Arrays" by Song et al., Department of Electronic Engineering, Tsinghua University, Beijing, 1000084 P R. China, 1992 IEEE, pp. 1939–1942.

"Impedance Characteristics of Circular Microstrip Patches" by Antoszkiewicz et al., vol. 38, No. 6, Jun., 1990, *IEEE Transactions on Antennas and Propagation*, pp. 942–946.

STUB-TUNED, PROXIMITY-FED, STACKED PATCH ANTENNA

FIELD OF THE INVENTION

The present invention relates in general to communication systems and is particularly directed to an enhanced bandwidth, lightweight, stacked patch antenna configuration for use in spaceborne and airborne phased array antenna systems.

BACKGROUND OF THE INVENTION

Co-pending U.S. patent application Ser. No. 68/781,530 entitled: "Flat Panel-Configured Lightweight Modular Antenna Assembly Having RF Amplifier Modules Embedded in Support Structure Between Radiation and Signal Distribution Panels," by S. Wilson et al, filed on even date herewith, assigned to the assignee of the present application and the disclosure of which is herein incorporated, describes and illustrates a lightweight antenna sub-panel architecture, which is particularly suited for airborne and space deployable applications.

In accordance with this improved antenna sub-panel architecture, a respective antenna sub-panel comprises a generally flat front or outer facesheet to which an array of antenna elements is affixed. This front facesheet is bonded to a first surface of a structurally rigid, thermally stable, lightweight intermediate structure, preferably formed as a honeycomb-configured metallic support member. A rear facesheet supporting a plurality of printed wiring boards containing beam-forming and signal distribution networks and additional printed wiring boards which contain DC power and digital control links is mounted to a second surface of the intermediate honeycomb-configured support member.

The intermediate honeycomb support member has a plurality of slots which retain RF signal processing (amplifier and phase/amplitude control) circuit modules, so as to provide a highly compact, integrated architecture, that is readily joined with other like laminate sub-panels, to provide an overall antenna spacial configuration that defines a prescribed antenna aperture. The thickness of the intermediate support member is defined in accordance with the lengths of the RF signal processing modules, such that input/output ports of the RF modules at opposite ends thereof are substantially coplanar with the conductor traces on the front and rear facesheets, whereby the RF modules provide the functionality of RF feed-through coupling connections between the rear and front facesheets of the antenna sub-panel.

In order to attain modular structure design objectives of reduced weight, low profile and decreased manufacturing and assembly complexity, the radiation elements that are distributed on the outer surface of the front facesheet are preferably patch-configured components. Since conventional patch antenna elements are pin-fed, narrow bandwidth devices (typically on the order of seven to ten percent), not only do they require a multi-step assembly and connection process, but the resulting panel structure has limited radiation performance capabilities.

SUMMARY OF THE INVENTION

In accordance with the present invention, such shortcomings of conventional patch antenna designs are effectively obviated by a new and stub-tuned, proximity-fed, stacked patch antenna configuration having a primary 'active' (disc-shaped) antenna patch element and a secondary 'parasitic' or passive (disc-shaped) antenna patch element of respectively different sizes, that resonate at respectively different or offset frequencies. The primary or active patch is field-coupled to, rather than pin-fed by, a conductive microstrip feed layer formed atop a dielectric substrate overlying a ground plane-defining front facesheet of a panel-configured antenna module.

The microstrip proximity feed further includes an antenna tuning stub adjacent to the active patch element, that produces an additional resonant frequency in the vicinity of resonant frequency of the active patch and that of the parasitic/passive patch. The close proximity of the tuning stub to the stacked patch antenna causes electromagnetic field energy associated with the tuning stub to be coupled with the active and parasitic patch structure, causing the dual patch antenna to exhibit an additional radiating mode, thereby creating a distributed resonance characteristic, that is a composite of the three components, and having an augmented bandwidth compared with that of a conventional patch antenna.

To facilitate manufacture of the stacked patch design, respective layers of space-qualifiable, pressure-sensitive adhesive material are interleaved among the parasitic patch, an insulating spacer disc, the active patch layer, the dielectric substrate and the ground plane-defining front facesheet.

DETAILED DESCRIPTION

Figure 1:
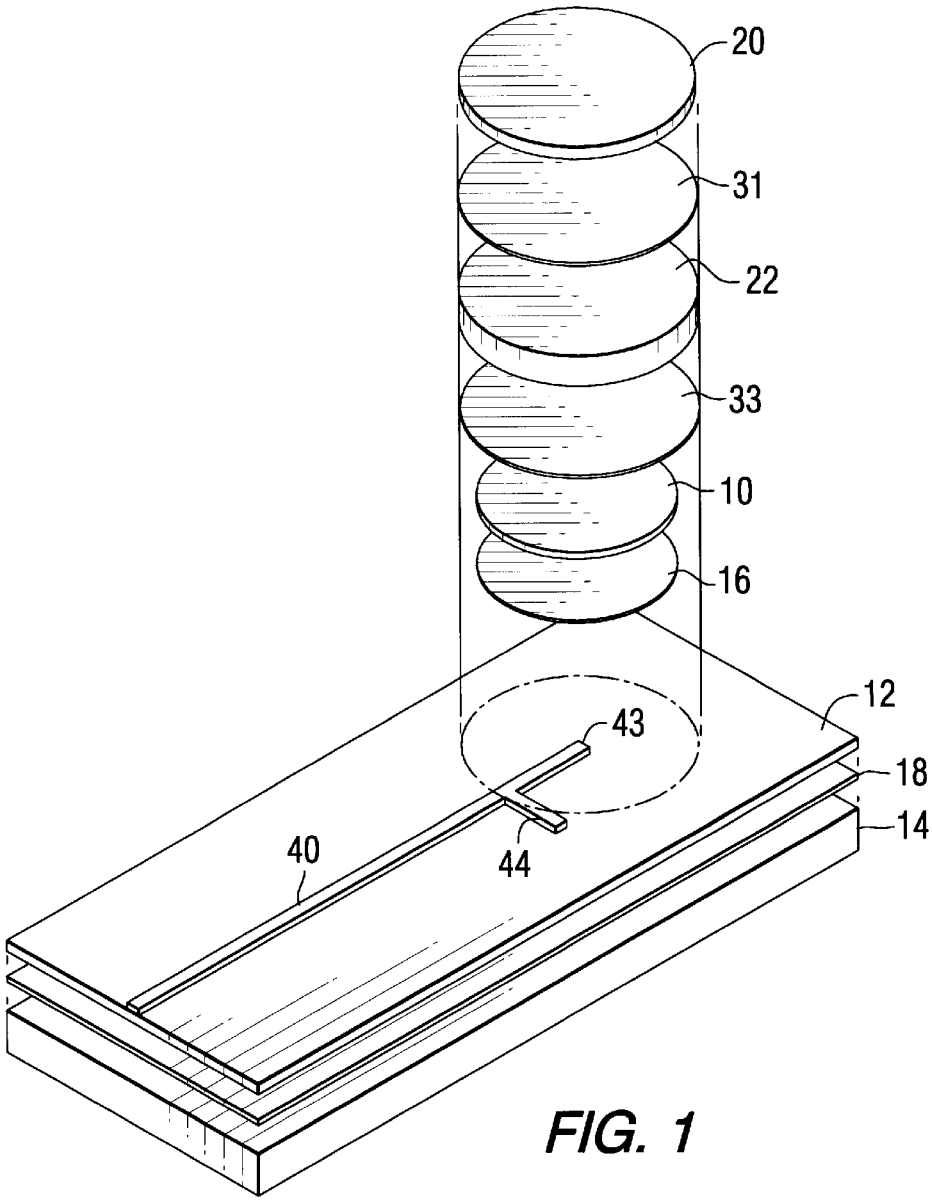
FIG. 1 is a diagrammatic perspective, exploded view of the stub-tuned, proximity-fed, stacked patch antenna of the present invention.
Figure 2:
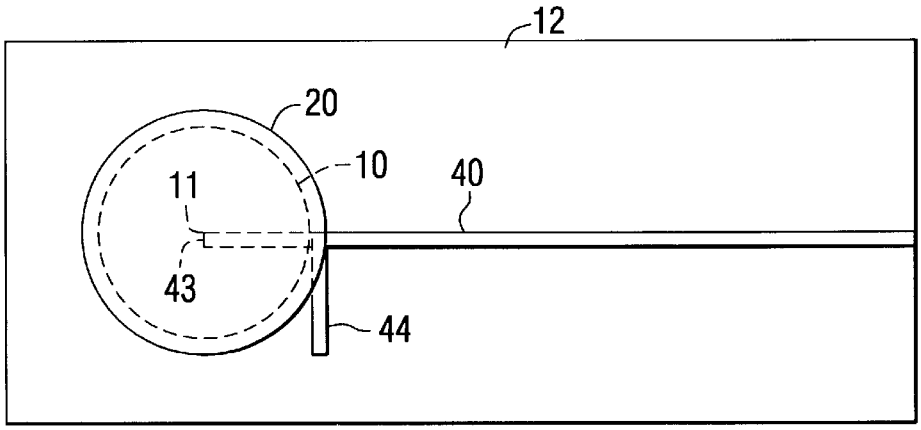
FIG. 2 is a diagrammatic top view of the stub-tuned, proximity-fed, stacked patch antenna of FIG. 1.
Figure 3:
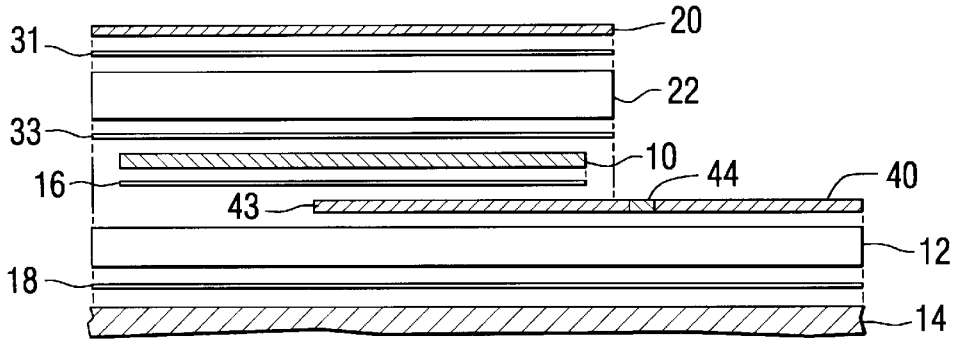
FIG. 3 is a diagrammatic side view of the stub-tuned, proximity-fed, stacked patch antenna of FIGS. 1 and 2.

FIGS. 1–3 diagrammatically illustrate a stub-tuned, proximity-fed, stacked patch antenna in accordance with the present invention, in which FIG. 1 is a diagrammatic perspective, exploded view, FIG. 2 is a diagrammatic top view, and FIG. 3 is a diagrammatic side view. As shown therein the stacked patch antenna comprises an 'active' antenna patch element 10, such as a disc-shaped conductive layer (e.g., a layer of copper having a thickness in a range on the order of 0.7–1.4 mils, and a radius that defines a first resonant frequency falling within the design bandwidth of the antenna). By active is meant that an antenna microstrip feed layer 40, such as a layer of fifty ohm transmission line, is field coupled to the patch element 10, so that in the radiating mode, patch element 10 serves as the primary or active emission element.

The active patch element 10 is disposed atop a dielectric substrate 12, such as a ten mil thickness of woven-glass Teflon, such as Ultralam, (Teflon and Ultralam are Trademarks of Dupont Corp.). This thin dielectric substrate 12 overlies a ground plane layer 14, such as the front facesheet of the panel-configured antenna module described in the above referenced Wilson et al application. To facilitate manufacture, patch element 10 is preferably attached to the dielectric substrate 12 by means of space-qualifiable adhesive material 16, such as a 'peel and stick' two mil thick layer of Y-966 acrylic PSA adhesive, manufactured by 3M. This adhesive material accommodates a layer of microstrip feed between the active patch element 10 and the dielectric substrate, so that the patch element is effectively plane-conformal with the substrate 12.

The adhesive material used for layer 16 is also used to bond the other layer components of the stacked or laminate patch structure of the present invention, so as to facilitate assembly of both an individual stacked patch antenna and also assembly of an array of such patches to the front facesheet of a modular antenna panel. To this end, a further layer 18 of adhesive is used to bond the dielectric substrate 12 to the ground plane layer 14.

The stacked patch configuration is further defined by a 'parasitic' or passive antenna patch element 20, such as a disc-shaped layer of one ounce copper foil, having a radius that defines a second resonant frequency that falls within the bandwidth of the antenna. Parasitic patch element 20 is concentric with and vertically spaced apart from patch 10, and has a radius larger than that of the active patch 10, so that parasitic patch element 20 has a resonant frequency that is slightly lower than that of patch 10. By parasitic or passive is meant that in the radiation mode, rather than being directly coupled to a feed trace, as is the active element 10, patch element 20 is instead parasitically stimulated by the field emitted by the active patch element 10. To support the larger radius passive copper foil patch 20 apart from active patch 10, an insulating spacer layer 22 (such as a dielectric foam layer) is disposed between the active antenna patch layer 10 and the passive conductive patch layer 20.

As described previously, to bond the various layers of the stacked patch structure into a compact integrated assembly, additional layers of adhesive material are preferably interleaved between successive conductive and dielectric layers of the stacked patch. Thus, an additional layer of adhesive material 31 is interleaved between and bonds together the copper foil patch 20 and the insulator spacer layer 22. Also, a further layer of adhesive material 33 is interleaved between and bonds together the foam insulator spacer layer 22 and the active patch 10. As noted above, the adhesive layer that bonds the active antenna patch element to the dielectric substrate accommodates the microstrip feed layer 40 between the active patch element 10 and the dielectric substrate, so that the patch element 10 is effectively plane-conformal with the dielectric substrate.

As pointed out briefly above, rather than provide a pin feed to the primary or active patch 10, which would require an electrical—mechanical bond attachment, such as a solder joint, signal coupling to and from active patch 10 is effected by proximity feed, in particular, field-coupled, conductive microstrip feed layer 40, which is patterned in accordance with a prescribed signal distribution geometry, associated with a plurality of patches of a multi-radiating element sub-array. Microstrip layer 40 extends from a (ribbon-bonded) feed location of a front facesheet of an antenna panel over the surface of the dielectric substrate 12 to a distal end 43 of microstrip 40, which terminates coincident with the center 11 of and serves as a proximity feed to the active patch element 10. Ribbon bonding of microstrip layer feed location on the front facesheet of the antenna panel to an associated input/output port of an RF signal processing module described in the above-referenced co-pending Wilson et al application is preferably effected by means of a low temperature, high frequency thermosonic bonding process, as described in co-pending U.S. patent application Ser. No. 08/781,541, by D. Beck et al, entitled: "High Frequency, Low Temperature Thermosonic Ribbon Bonding Process for System-Level Applications," filed on even date herewith, assigned to the assignee of the present application and the disclosure of which is herein incorporated.

In accordance with the thermosonic ribbon bonding process described in the Beck et al application, the respective bonding sites of the antenna panels are maintained at a relatively low temperature, preferably in a range of from 25° C. to 85° C., so as to avoid altering the design parameters of system circuit components, especially the characteristics of the circuits within RF signal processing modules that are retained within an intermediate support structure of the antenna. To achieve the requisite atomic diffusion bonding energy, without causing fracturing or destruction of the ribbon or its interface with the low temperature bond sites, the vibrational frequency of the ultrasonic bonding head is increased to an elevated ultrasonic bonding frequency above 120 KHz and preferably in a range of from 122 KHz to 140 KHz. This combination of low bonding site temperature, high ultrasonic frequency and ribbon configured interconnect material makes it possible not only to perform thermosonic bonding between metallic sites that are effectively located in the same (X–Y) plane, but between bonding sites that are located in somewhat different planes, namely having a measurable orthogonal (Z) component therebetween.

Figure 4:
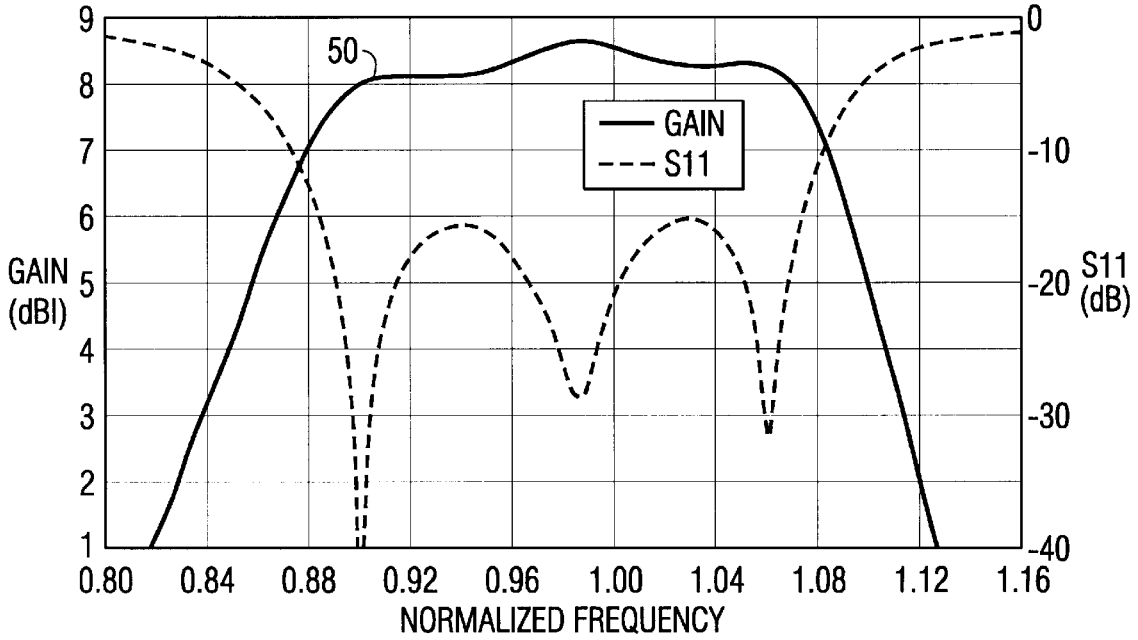
FIG. 4 illustrates the normalized gain and S parameter (S11) vs. normalized frequency characteristic diagram of the stub-tuned, proximity-fed, stacked patch antenna of the invention.

The microstrip feed layer 40 further includes an antenna tuning stub portion 44 extending generally orthogonal to and located in close proximity of the outer edge 13 of the active patch element 10. The length and location of the tuning stub 44 of microstrip feed layer 40 are empirically defined to establish an additional resonant frequency $f_{44}$ between the resonant frequency $f_{10}$ of the active patch 10 and the resonant frequency $f_{20}$ of the parasitic patch 20, as illustrated in the normalized gain and S parameter (S11) vs. normalized frequency characteristic diagram of FIG. 4. As a non-limiting example, tuning stub 44 may have a length on the order of one-half the radius of the active patch element 10 and may be located immediately adjacent to the outer edge 13 of active patch 10, as projected upon the mircostrip feed layer 40, as shown in the diagrammatic top view of FIG. 2, and the side view of FIG. 3.

The exact location of tuning stub 44 will depend upon the degree of resonant interaction and thereby the composite gain-bandwidth characteristic desired among the components of the stacked patch antenna structure. As described above, locating the tuning stub 44 in close proximity (e.g., within one-tenth of a wavelength of the edge 13 of the active patch) has been found to cause electromagnetic field energy associated with the tuning stub 44 to be coupled with the active and parasitic patch structure 10–20, causing the dual patch antenna structure to exhibit an additional radiating mode, thereby creating a distributed resonance effect that produces a composite gain-bandwidth characteristic, shown at 50, having a wider frequency range than that of a conventional patch antenna (on the order of 15–20%, compared with the 10% figure of the prior art patch antenna, referenced above).

As will be appreciated from the foregoing description, the objective of a reduced weight, low profile patch antenna that can be easily manufactured and attached to the facesheet of a modular antenna panel assembly is readily achieved by the stub-tuned, proximity-fed, stacked patch antenna configuration of the present invention. The combination of an 'active' antenna patch element, 'parasitic' antenna patch element, and associated proximity feed trace and tuning stub, which causes resonances at respectively different frequencies, creates a distributed resonance characteristic, having an augmented bandwidth. Manufacture of the stacked patch antenna is facilitated by the use of both a proximity feed and the interleaving of adhesive layers among the respective components of the stacked structure.

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein but intend to cover all such changes and modifications as are obvious to one of ordinary skill in the art.

What is claimed:

1. A stacked patch-configured antenna element comprising:

a conductive feed layer formed on an insulating layer atop a conductive ground plane member, and including a tuning stub adjacent to a selected portion thereof;

a first active conductive antenna patch layer insulated from and proximity-coupled to said selected portion of said conductive feed layer, so that projection of said first active antenna patch layer upon said selected portion of said conductive feed layer does not overlap said tuning stub, but is such that projection of a perimeter edge of said first active conductive antenna patch layer upon said selected portion of said conductive feed layer is spaced apart from said tuning stub of said conductive layer; and a second passive conductive antenna patch layer supported atop and spaced apart from said first conductive antenna patch layer.

2. A stacked patch-configured antenna element according to claim 1, further including an insulating spacer disposed between said first active conductive antenna patch layer and said second passive conductive antenna patch layer.

3. A stacked patch-configured antenna element according to claim 2, further including respective adhesive layers securing said second conductive antenna patch layer, said insulating spacer, said first conductive antenna patch layer, said insulating layer and said conductive ground plane member in a laminate structure.

4. A stacked patch-configured antenna element according to claim 1, wherein said first and second conductive antenna patch layers are disc-shaped.

5. A stacked patch-configured antenna element according to claim 4, wherein said first conductive antenna patch layer has a diameter less than that of said second conductive antenna patch layer.

6. A stacked patch-configured antenna element according to claim 1, wherein said tuning stub is spaced apart from said projection of a perimeter edge of said first active conductive antenna patch layer upon said selected portion of said conductive feed layer by a distance less than the diameter of said first, active conductive antenna patch layer.

7. A stacked patch-configured antenna element according to claim 1, wherein said tuning stub has a length on the order of one-half the radius of said active conductive antenna patch layer.

8. A stub-tuned, proximity-fed, stacked patch antenna architecture comprising an active antenna patch element, having a first resonant frequency, disposed atop a dielectric substrate overlying a ground plane layer, a passive antenna patch element, having a second resonant frequency, supported in spaced apart relationship with respect to said active antenna patch element, and a proximity feed layer field-coupled to said active antenna patch element, said proximity feed layer having a tuning stub that is spaced apart from a projection of said active antenna patch element upon said proximity feed layer and is operative to cause said stacked patch antenna architecture to exhibit an additional radiating mode, thereby producing a distributed antenna resonance characteristic.

9. A stub-tuned, proximity-fed, stacked patch antenna architecture according to claim 8, wherein said tuning stub has a length on the order of one-half the radius of said active patch element.

10. A stub-tuned, proximity-fed, stacked patch antenna architecture according to claim 8, wherein said tuning stub is located immediately adjacent to an outer edge of said projection of said active antenna patch element upon said proximity feed layer.

11. A stub-tuned, proximity-fed, stacked patch antenna architecture according to claim 8, wherein said passive antenna patch element is concentric with and vertically spaced apart from said active antenna patch element.

12. A stub-tuned, proximity-fed, stacked patch antenna architecture according to claim 8, further including an insulating spacer layer disposed between and supporting said active antenna patch element apart from said passive antenna patch element.

13. A stub-tuned, proximity-fed, stacked patch antenna architecture according to claim 12, further comprising adhesive layers securing said passive antenna patch element, said insulating spacer, said active antenna patch element, said proximity layer, said dielectric substrate and said ground plane in a laminate structure.

14. A stub-tuned, proximity-fed, stacked patch antenna architecture according to claim 13, wherein said adhesive layers comprise peel and stick adhesive material.

15. A stub-tuned, proximity-fed, stacked patch antenna architecture according to claim 8, wherein said active antenna patch element is a disc-shaped metallic layer, and wherein said passive antenna patch element is comprised of a metallic foil disc having a radius larger than that of said active antenna patch element.

16. A method of increasing the operational bandwidth of a stacked patch antenna, said stacked patch antenna having an active antenna patch element that resonates at a first resonant frequency, disposed atop a dielectric substrate overlying a ground plane layer, and a passive antenna patch element that resonates at a second resonant frequency, supported in spaced apart relationship with respect to said active antenna patch element, said method comprising the steps of:

(a) coupling a signal feed to said active antenna patch element; and (b) providing a tuning stub with said signal feed in close proximity to said active antenna patch element, such that projection of said active antenna patch element upon said signal feed layer does not overlap said tuning stub, but is such that projection of a perimeter edge of said active antenna patch element upon said signal feed layer is adjacent to said tuning stub, and wherein said tuning stub is configured to cause said stacked patch antenna to exhibit an additional radiating mode, thereby producing a distributed antenna resonance characteristic.

17. A method according to claim 16, wherein step (a) comprises proximity coupling a microstrip feed layer to said active antenna patch element, so as to provide field-coupling of energy between said feed layer and said active antenna patch element, said microstrip feed layer including said tuning stub extending therefrom adjacent to said projection of said active antenna patch element upon said feed layer.

18. A method according to claim 17, wherein said tuning stub has a length on the order of one-half the radius of said active antenna patch element.

19. A method according to claim 18, wherein said tuning stub is located immediately adjacent to projection of an outer edge of said active antenna patch element upon said feed layer.

20. A method according to claim 19, wherein said passive antenna patch element is concentric with and vertically spaced apart from said active antenna patch element.

21. A method according to claim 20, further including an insulating spacer layer disposed between and supporting said active antenna patch element apart from said passive antenna patch element, and wherein adhesive layers secure said passive antenna patch element, said insulating spacer, said active antenna patch element, said proximity layer, said dielectric substrate and said ground plane in a laminate structure.

22. A method according to claim 21, wherein said adhesive layers comprise peel and stick adhesive material.

23. A method according to claim 20, wherein said active antenna patch element is a disc-shaped metallic layer, and wherein said passive antenna patch element is comprised of a metallic foil disc having a radius larger than that of said active antenna patch element.

* * * * *